US007250957B2

(12) United States Patent
Hong

(10) Patent No.: US 7,250,957 B2
(45) Date of Patent: Jul. 31, 2007

(54) LIQUID CRYSTAL DISPLAY DEVICE AND DRIVING METHOD THEREOF

(75) Inventor: Hyung-Ki Hong, Seoul (KR)

(73) Assignee: LG.Philips LCD Co., Ltd., Seoul (KR)

( * ) Notice: Subject to any disclaimer, the term of this patent is extended or adjusted under 35 U.S.C. 154(b) by 652 days.

(21) Appl. No.: 10/745,703

(22) Filed: Dec. 29, 2003

(65) Prior Publication Data

US 2004/0135755 A1 Jul. 15, 2004

(30) Foreign Application Priority Data

Dec. 30, 2002 (KR) ..... 10-2002-0087536

(51) Int. Cl.
*G09G 5/02* (2006.01)

(52) U.S. Cl. ..... 345/694; 345/596

(58) Field of Classification Search ..... 345/87, 345/88, 89, 98, 204, 690, 694, 589, 590, 345/591, 600, 604, 596
See application file for complete search history.

(56) References Cited

U.S. PATENT DOCUMENTS 6,084,560 A * 7/2000 Miyamoto ..... 345/89
6,219,016 B1 * 4/2001 Lee ..... 345/87
6,987,499 B2 * 1/2006 Yamaguchi et al. ..... 345/89

* cited by examiner

*Primary Examiner*—Amr A. Awad
*Assistant Examiner*—Tom V Sheng
(74) *Attorney, Agent, or Firm*—McKenna Long & Aldridge LLP

(57) ABSTRACT

A liquid crystal display device having an improved viewing angle that prevents degradation of image quality. The device includes a timing control unit arranged to receive image data and a control signal from a graphic processing unit through an interface unit, a gate driver integrated circuit receiving a control signal from the timing control unit, a gate on/off power signal from a DC/DC converter, the gate driver integrated circuit supplies a gate pad unit of a liquid crystal display panel with a scan signal, a halftone gray driving mode converting unit implementing halftone gray by receiving the image data and the control signal from the timing control unit, and a data driver integrated circuit supplying a data pad unit of the liquid crystal display panel with image data by receiving new image data from the halftone gray driving mode converting unit.

9 Claims, 6 Drawing Sheets

LIQUID CRYSTAL DISPLAY DEVICE AND DRIVING METHOD THEREOF

This application claims the benefit of Korean Patent Application No. P20002-87536 filed on Dec. 30, 2002, which is hereby incorporated by reference for all purposes as if fully set forth herein.

BACKGROUND OF THE INVENTION

1. Field of the Invention

The present invention relates to a liquid crystal display device having an improved viewing angle, and more particularly, to a liquid crystal display device and a driving method thereof to prevent the degradation of image quality that may be generated from applying halftone gray.

2. Background of the Related Art

Generally, a liquid crystal display device is employed for displaying an image by supplying matrix-like arranged liquid crystal cells with data signals according to image information to adjust a light transmission of liquid crystal cells.

A liquid crystal display device consists of a liquid crystal display panel on which a plurality of liquid crystal cells forming a pixel unit are arranged in an active matrix form and a driver integrated circuit (IC) for driving the liquid crystal cells.

The liquid crystal display panel consists of a color filter substrate, a thin film transistor array substrate opposite the color filter substrate, and a liquid crystal layer inserted between the color filter and thin film transistor array substrates.

Common and pixel electrodes are formed on the two inner sides of the color filter and thin film transistor array substrates, respectively, to apply an electric field to the liquid crystal display panel. Each of the pixel electrodes is formed on the thin film transistor array substrate to match the corresponding liquid crystal cell, while the common electrode is formed in one body on an entire surface of the inner side of the color filter substrate. Hence, a light transmission of each of the liquid crystal cells can be individually adjusted by controlling a voltage applied to the corresponding pixel electrode while a voltage is applied to the common electrode.

A plurality of data lines are also formed on the thin film transistor array substrate of the liquid crystal display panel to transfer data signals supplied from a data driver integrated circuit to the liquid crystal cells. A plurality of gate lines that cross the data lines transfer scan signals supplied from a gate driver integrated circuit to the liquid crystal cells. And, the liquid crystal cells are defined by crossings between the data and gate lines.

The gate driver integrated circuit sequentially supplies a plurality of the gate lines with the scan signals, respectively to select each line of the matrix-like arranged liquid crystal cells sequentially. And, the liquid crystal cells of the selected line are provided with the data signal from the data driver integrated circuit.

Thus, in order to control the voltage applied to the pixel electrode by each liquid crystal cell, a thin film transistor is formed as a switching device in each of the liquid crystal cells, and a conductive channel is generated between source/drain electrodes of the thin film transistor in each of the liquid crystal cells when the scan signal is applied to a gate electrode of the corresponding thin film transistor through the corresponding gate line. In this case, the data signal applied to the source electrode of the thin film transistor through the data line, via the drain electrode of the thin film transistor, to be applied to the corresponding pixel electrode, whereby the light transmission of the corresponding liquid crystal cell is controlled.

The above-explained liquid crystal display device is explained by referring to the attached drawings as follows.

FIG. 1 illustrates a schematic layout of a liquid crystal display panel prepared by bonding a thin film transistor array and a color filter substrate to each other.

In FIG. 1, a liquid crystal display panel 10 includes an image display unit 13 on which a plurality of liquid crystal cells are arranged like a matrix form, a gate pad unit 14 to which gate lines of the image display unit 13 are connected, and a data pad unit 15 connected to data lines thereof. The gate and data pad units 14 and 15 are formed on a peripheral area of a thin film transistor array substrate 11 which is not overlapped with a color filter substrate 12. The gate pad unit 14 supplies the gate lines of the image display unit 13 with scan signals supplied from a gate driver integrated circuit, and the data pad unit 15 supplies the data lines of the image display unit 13 with image information supplied from a data driver integrated circuit.

Although not shown in the drawing specifically, on the thin film transistor array substrate 11 of the image display unit 13, the data lines to which the image information is applied and the gate lines to which the scan signals are applied are arranged to cross each other.

Moreover, on the thin film transistor array substrate 11 of the image display unit 13, pixel electrodes are connected to the corresponding thin film transistors to drive the liquid crystal cells, and a passivation layer is on an entire surface to protect the electrodes and thin film transistors.

Color filters, on the color filter substrate 12 of the image display unit 13, are coated and separated by a black matrix into cell units and a common transparent electrode as a counter electrode against the pixel electrodes on the thin film transistor array substrate 11.

The above-constructed thin film transistor array and color filter substrates 11 and 12 are separated by a spacer to provide a cell gap. The cell gap is filled with liquid crystals.

Then, the thin film transistor array and color filter substrates 11 and 12 are bonded to each other by a sealing unit 16 formed on a periphery of the image display unit 13.

However, the above-explained liquid crystal display device has a small viewing angle and a brightness relatively poorer than that of other display devices. Hence, many efforts have been made to improve the viewing angle and light transmission in LCD field.

SUMMARY OF THE INVENTION

Accordingly, the present invention is directed to a liquid crystal display device and driving method thereof that substantially obviates one or more problems due to limitations and disadvantages of the related art.

An advantage of the present invention is to provide a liquid crystal display device and a driving method thereof to improve a viewing angle characteristic by halftone gray driving.

Another advantage of the present invention is to provide a liquid crystal display device and driving method thereof to improve a viewing angle characteristic and maintain a resolution of a normal driving mode by matching each pixel brightness sequence of an original image with a brightness sequence of a changed image on halftone gray driving.

Additional advantages and features of the invention will be set forth in part in the description which follows and in part will become apparent to those having ordinary skill in the art upon examination of the following or may be learned from practice of the invention. The advantages of the invention may be realized and attained by the structure particularly pointed out in the written description and claims hereof, as well as the appended drawings.

To achieve these and other advantages and in accordance with the purpose of the invention, as embodied and broadly described herein, a liquid crystal display device according to the present invention includes a timing control unit to receive image data and a control signal from a graphic processing unit through an interface unit, a gate driver integrated circuit receiving a control signal from the timing control unit and a gate on/off power signal from a DC/DC converter, and a gate pad unit of a liquid crystal display panel with a scan signal and a halftone gray driving mode converting unit implementing halftone gray receiving the image data and the control signal from the timing control unit, and a data driver integrated circuit receiving new image date from the halftone gray driving mode converting unit and supplying a data pad unit of the liquid crystal display panel with the new image data.

Preferably, the liquid crystal display device further includes a switching unit between the halftone gray driving mode converting unit and the data driver integrated circuit to switch between a halftone gray driving mode and a normal driving mode based upon a control signal from the timing control unit.

Preferably, the halftone gray driving mode converting unit includes a data storing unit arranged to group and store the data supplied from the timing control unit into at least two pixel units and a data converting unit converting gray levels of the data stored in the data storing unit to a white level, a black level, and other gray level based upon a lookup table.

More preferably, the liquid crystal display device further includes a data comparison unit between the data storing unit and the data converting unit to compare a brightness sequence for each pixel of the data.

In another aspect of the present invention, a liquid crystal display device includes a timing control unit arranged to receive image data and a control signal from a graphic processing unit through an interface unit, a switching unit receiving the control signal from the timing control unit to selectively switch between a halftone gray mode and a normal mode, a data storing unit arranged to group and store image data supplied from the timing control unit into at least two pixel units, a data comparison unit to determine a brightness sequence by comparing a brightness sequence for each pixel of the image data stored in the data storing unit, a data converting unit receiving information and image data for the brightness sequence for each pixel from the data comparison unit to convert gray levels of the information and image data to a white level, a black level, and another gray level using a lookup table wherein the brightness sequence for each pixel coincides with previous data, and a data driver integrated circuit receiving new image data from the data converting unit and supplying a data pad unit of a liquid crystal display panel with the image information.

In a further aspect of the present invention, a method of driving a liquid crystal display device includes supplying image data and a control signal to a timing control unit, switching between a halftone gray mode and a normal mode based upon receipt of a control signal from the timing control unit, storing the image data supplied from the timing control unit as at least two pixel units in a data storing unit, determining a brightness sequence by having a data comparison unit compare a brightness sequence for each pixel of the image data stored in the data storing unit, receiving information and data for the brightness sequence for each pixel from the data comparison unit and converting the information and data to a white level, a black level, and another level based upon a lookup table value, wherein the brightness sequence per pixel is made to coincide with previous data, and supplying a data pad unit of a liquid crystal display panel with image information by receiving new data from a data converting unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE ILLUSTRATED EMBODIMENTS

Reference will now be made in detail to the preferred embodiments of the present invention, examples of which are illustrated in the accompanying drawings.

Figure 1:
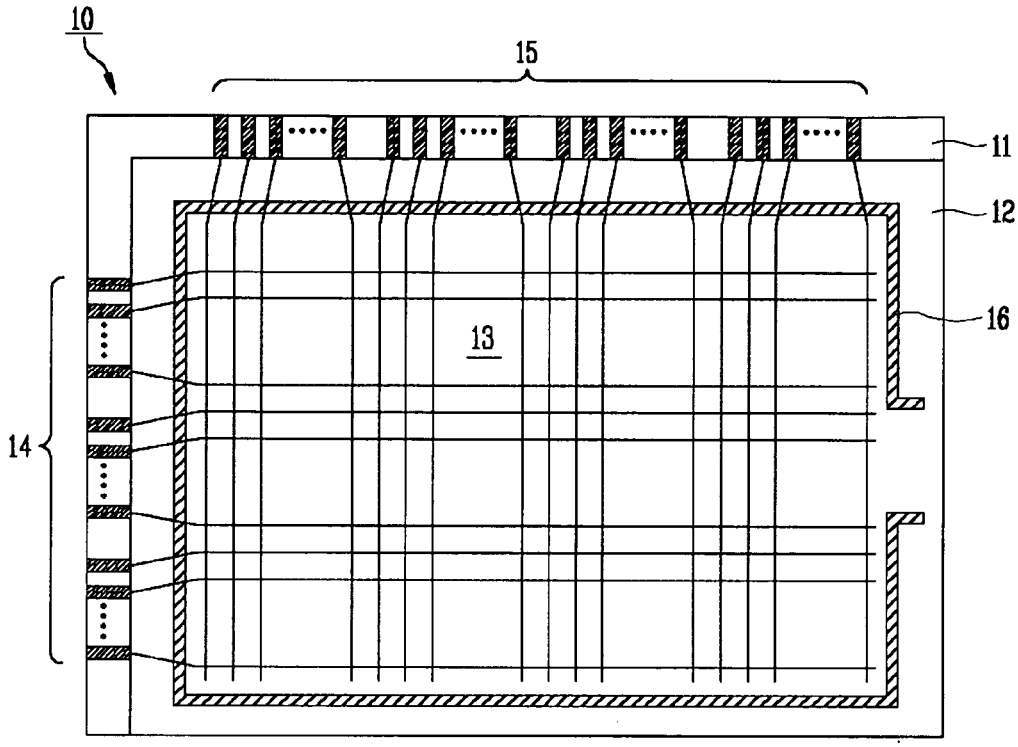
FIG. 1 RELATED ART
FIG. 1 illustrates a schematic layout of a liquid crystal display panel prepared by bonding a thin film transistor array and color filter substrate to each other.
Figure 2:
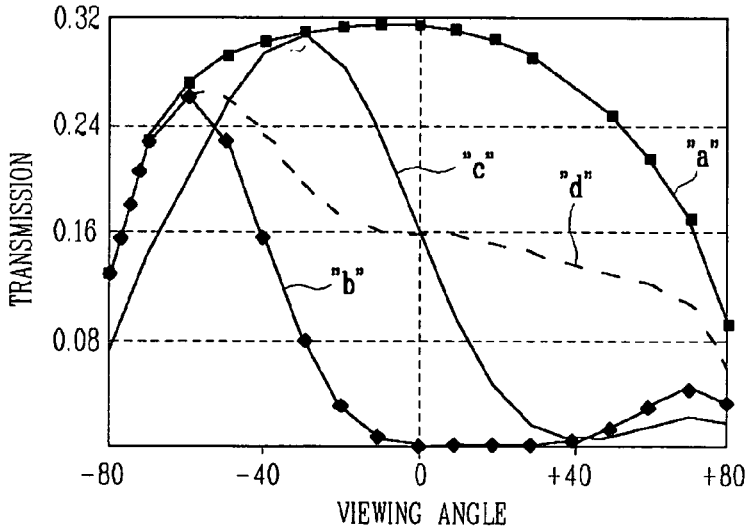
FIG. 2 illustrates a graph of a viewing angle/transmission characteristic of a liquid crystal display device using TN (twisted nematic) liquid crystals.

FIG. 2 illustrates a graph of a viewing angle/transmission characteristic of a liquid crystal display device using TN (twisted nematic) liquid crystals, in which curves "a", "b", "c", and "d" indicate viewing angle/transmission characteristics for white level, black level, middle gray level, and halftone gray level, respectively.

In a case of the curve "a", i.e., white level, the transmission is good for the viewing angle within a range of (−)80°-80°. Specifically, at least 0.24 of the transmission is high within the viewing angle range of (−)60°-60° when 0° is used as a reference. As an absolute value of the viewing angle increase over 60°, the transmission abruptly decreases.

In a case of the curve "b", i.e., black level, the transmission is very low in an area deviating from the viewing angle of (−)80°-(−)40°. Namely, in the black level, the viewing angle is about (−)80°-(−)40° and the viewing angle characteristic is very weak.

In a case of the curve "c", i.e., middle gray level, the transmission is at least 0.16 within the viewing angle range of (−)60°-(−)20° by taking '(−)20°' as a reference. And, the transmission is remarkably reduced in the rest of the range. Moreover, compared to the black level (curve "b"), the curve "c" has a viewing angle that is wider. However, it can be inferred that the viewing angle characteristic of the curve "c" is much weaker than that of the white level (curve "a").

The curve "d" represents the viewing angle/transmission characteristic of a halftone gray method is applied to combine the white level (curve "a") with the black level (curve "b"). When compared to the curve "c" which does not employ the halftone gray method, the curve "d" has a transmission slightly less than that of the curve "c" within the viewing angle range of (−)40°-0°. Yet, the transmission is improved overall. Namely, the viewing angle characteristic is improved in the range where the transmission is improved. Therefore, the present invention improves the viewing angle characteristic using the halftone gray method.

The related art halftone gray method can be implemented in a manner in which pixels having the same gray level are grouped into at least two areas including a main pixel part and a sub pixel part, and a voltage applied to each liquid crystal layer is separately set up.

Figure 3:
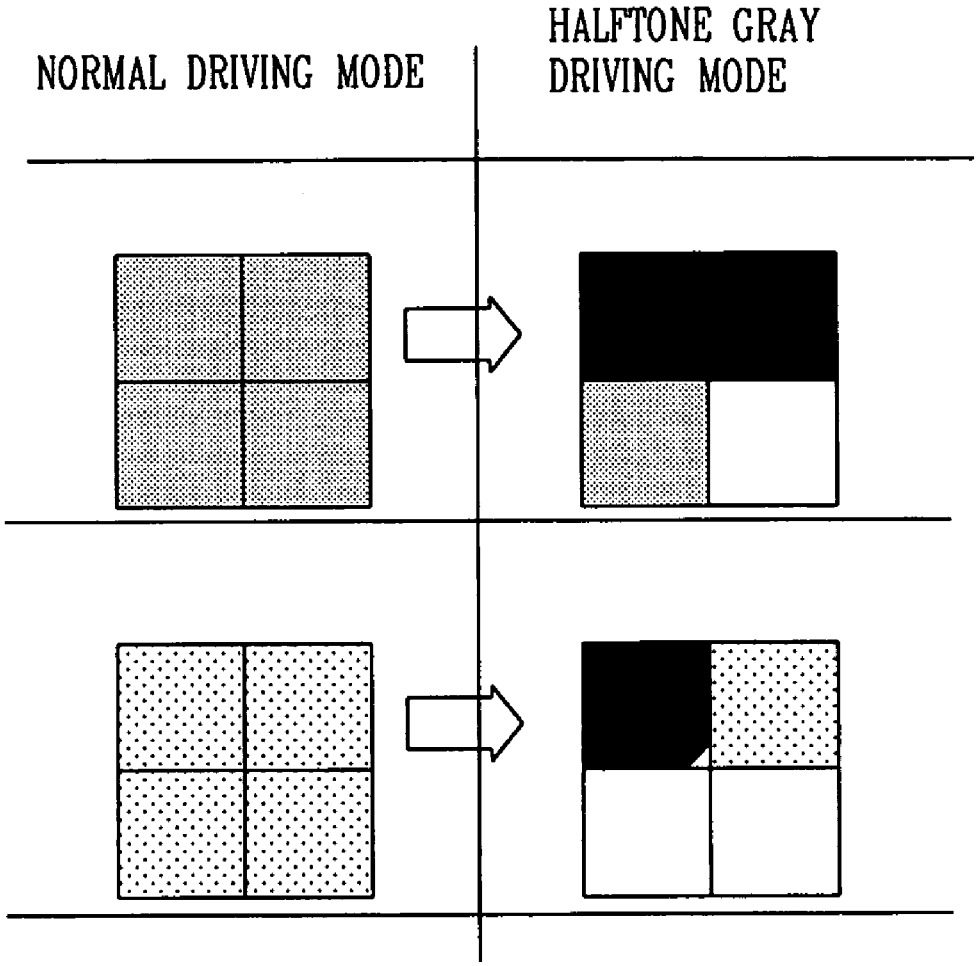
FIG. 3 illustrates a diagram of images displayed on normal and halftone gray driving modes, respectively.

For instance, in normal driving (hereinafter "normal driving" means driving of a general liquid crystal display device instead of halftone gray driving), dark gray levels displayed on four pixels, as shown in FIG. 3, can be represented by a white level having a good viewing angle characteristic on halftone gray driving, a black level, and other gray levels. In this case, a brightness of the dark gray level displayed on normal driving mode should be equal to an average brightness displayed on the four pixels on halftone gray level mode. Likewise, a bright gray level displayed on the four pixels under normal driving can be represented by white level, black level, and other gray levels. The average brightness of such levels is equal to the brightness displayed on normal driving. And, the count of the pixels displaying the white level is increased greater than that of the pixels displaying the dark gray level. The white level is a gray level of which the viewing angle characteristic is the best. As the count of the pixels displaying the white gray level increases, the viewing angle characteristic is improved. Hence, in the case of applying the halftone gray method, compared to the dark gray level, the bright gray level can be improved.

In the present invention, the above-explained halftone gray driving can be implemented by adding a halftone gray mode converting unit between a timing control unit and a data driver integrated circuit.

A liquid crystal display device and a driving method thereof are explained by referring to the attached drawings in detail as follows.

Figure 4:
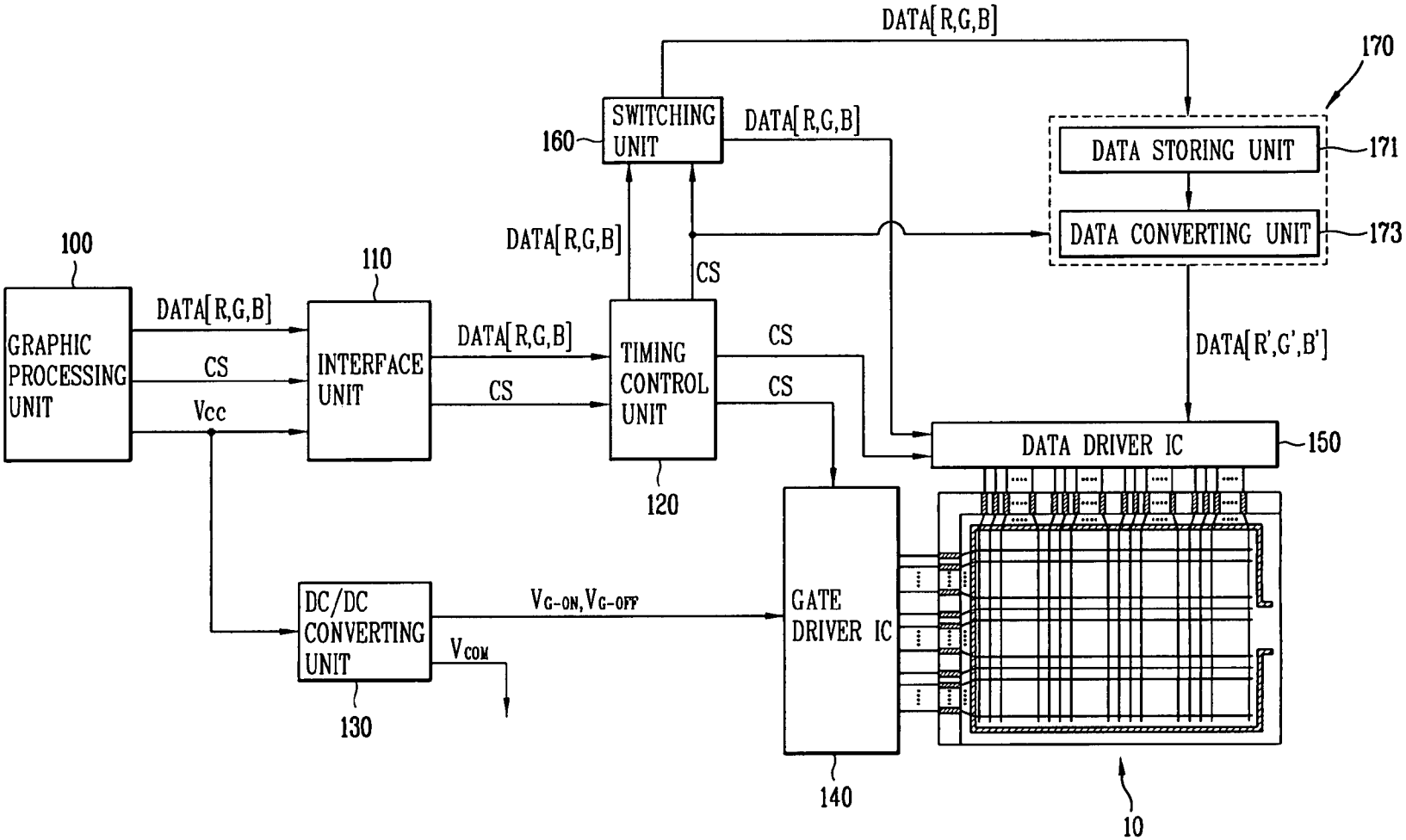
FIG. 4 illustrates a block diagram of a liquid crystal display device according to an embodiment of the present invention.

FIG. 4 illustrates a block diagram of a liquid crystal display device according to an embodiment of the present invention.

In FIG. 4, a liquid crystal display device according to the present invention includes a timing control unit 120 that receives image data R, G, B and a control signal CS from a graphic processing unit 100 through an interface unit 110, a gate driver integrated circuit 140 that supplys a gate pad unit of a liquid crystal display panel 10 with a scan signal by receiving a control signal CS from the timing control unit 120 and by receiving a gate on/off power signal from a DC/DC converter 130, a halftone gray driving mode converting unit 170 that stores data by at least two pixel units by receiving the image data R, G, and B and the control signal CS from the timing control unit 120 and subsequently converting the stored data to new image data R', G', and B', supplying the new image data to a data driver integrated circuit 150, and the data driver integrated circuit 150 supplies a data pad unit of the liquid crystal display panel 10 with the control signal CS supplied from the timing control unit 120 and the new image data R', G', and B' supplied from the halftone gray driving mode converting unit 170.

Moreover, a switching unit 160 is provided between the halftone gray driving mode converting unit 170 and the data driver integrated circuit 150, and switches between a halftone gray driving mode and a normal driving mode based upon receiving a control signal CS enabling of a normal or halftone gray driving selection from the timing control unit 120.

When the normal driving mode is selected, the data driver integrated circuit 150 receives the image data R, G, and B from the switching unit 160 and the control signal CS from the timing control unit 120. This information is supplied to the data pad unit of the liquid crystal display panel 10 and then an image is displayed on the liquid crystal display panel 10.

When the halftone gray driving mode is selected by the switching unit 160, the halftone gray driving mode converting unit 170 receives image data R, G, and B from the switching unit 160 and the control signal CS from the timing control unit 120. The halftone gray driving converting unit 170 supplies the data driver integrated circuit 150 with the new image data R', G', and B' for halftone gray driving.

The halftone gray driving mode converting unit 170 includes a data storing unit 171 that groups the data applied from the switching unit 160 into at least two pixel units to store, and a data converting unit 173 that converts gray levels of the data R, G, and B stored in the data storing unit 171 to a white level, a black level, and other gray level using a lookup table. The data driver integrated circuit 150 is supplied with the converted new data R', G', and B'.

A driving method of the halftone gray driving mode converting unit 170 is explained in detail by referring to FIG. 5 as follows.

Figure 5:
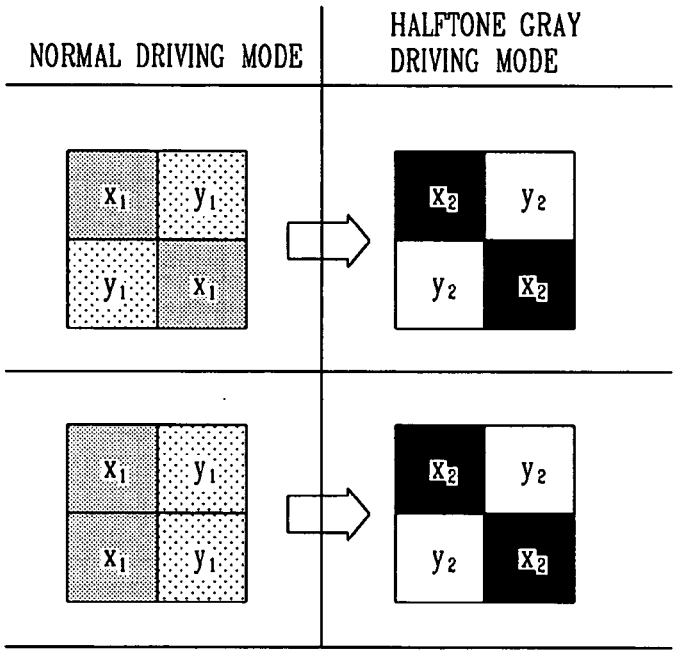
FIG. 5 illustrates a diagram of images displayed on normal and halftone gray driving modes, respectively.

FIG. 5 illustrates a diagram of images displayed in normal and halftone gray driving modes, respectively.

Figure 6:
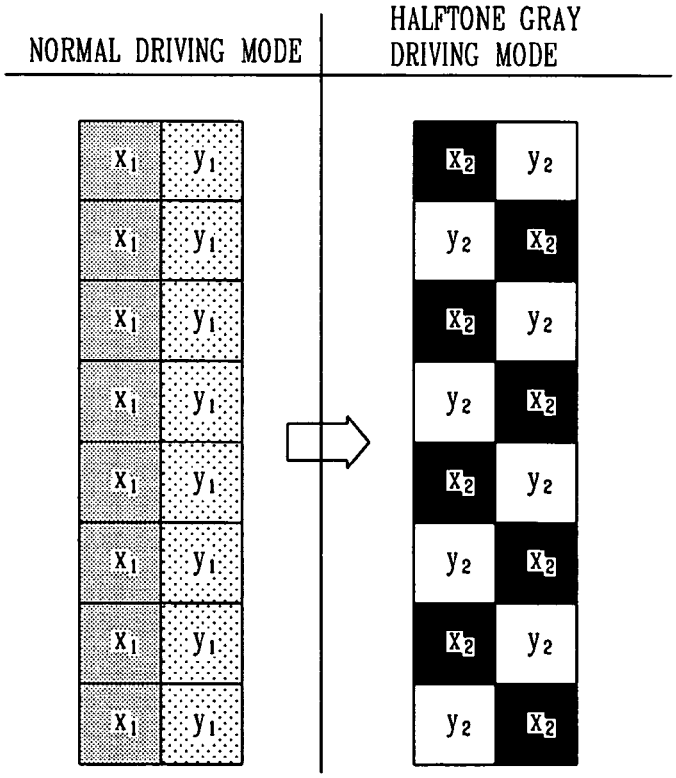
FIG. 6 illustrates a diagram of images displayed at normal and halftone gray driving modes for straight-lined image, respectively.

In FIG. 5, in normal driving mode, in a case of an image represented on four pixels by a dark gray level x1 and a bright gray level y1, the data storing unit 171 receives image data [x1, y1] representing the dark and bright gray levels respectively from the switching unit 160, stores the image data [x1, y1] by four pixel unit, and supplies the data converting unit 173 with the data of the four pixel unit. The data converting unit 173 converts the data [x1, y1] supplied from the data storing unit 171 to a black level x2 and a white level y2 using information set by a look up table and then supplies the data driver integrated circuit 150 with the converted data R', G' and B'. An average brightness of the black and white levels x2 and y2 converted by the data converting unit 173 should be equal to an average brightness represented by a combination of the dark and bright gray levels x1 and y1. Yet, the black and white level x2 and y2 displayed in the halftone gray driving mode are always arranged in a zigzag pattern on a screen, regardless of a brightness sequence per pixel of an original image. In the case of an image in which the dark and bright gray levels x1 and y1 are represented by straight lines, respectively, the image represented by the black and bright gray levels x2 and y2 are arranged in a zigzag-pattern on the screen in the halftone gray driving mode. Because human resolution is low in a 45° direction as the black and white levels x2 and y2 are arranged in the zigzag pattern, straight lines in horizontal and vertical directions are not displayed sharp. For instance, when the dark and bright gray levels x1 and y1 are arranged vertically in parallel to display a straight-lined image, as shown in FIG. 6, the black and white levels x2 and y2 have a zigzag pattern in halftone gray mode to display the image. In such a case, a resolution of the image is poor even if the viewing angle is improved.

In order to overcome such a problem, the present invention provides a liquid crystal display device and driving method thereof to prevent resolution from being degraded in halftone gray mode by adding a data comparison unit, which compares a brightness of a position of each pixel to determine a brightness sequence, between the data storing unit and the data converting unit.

Figure 7:
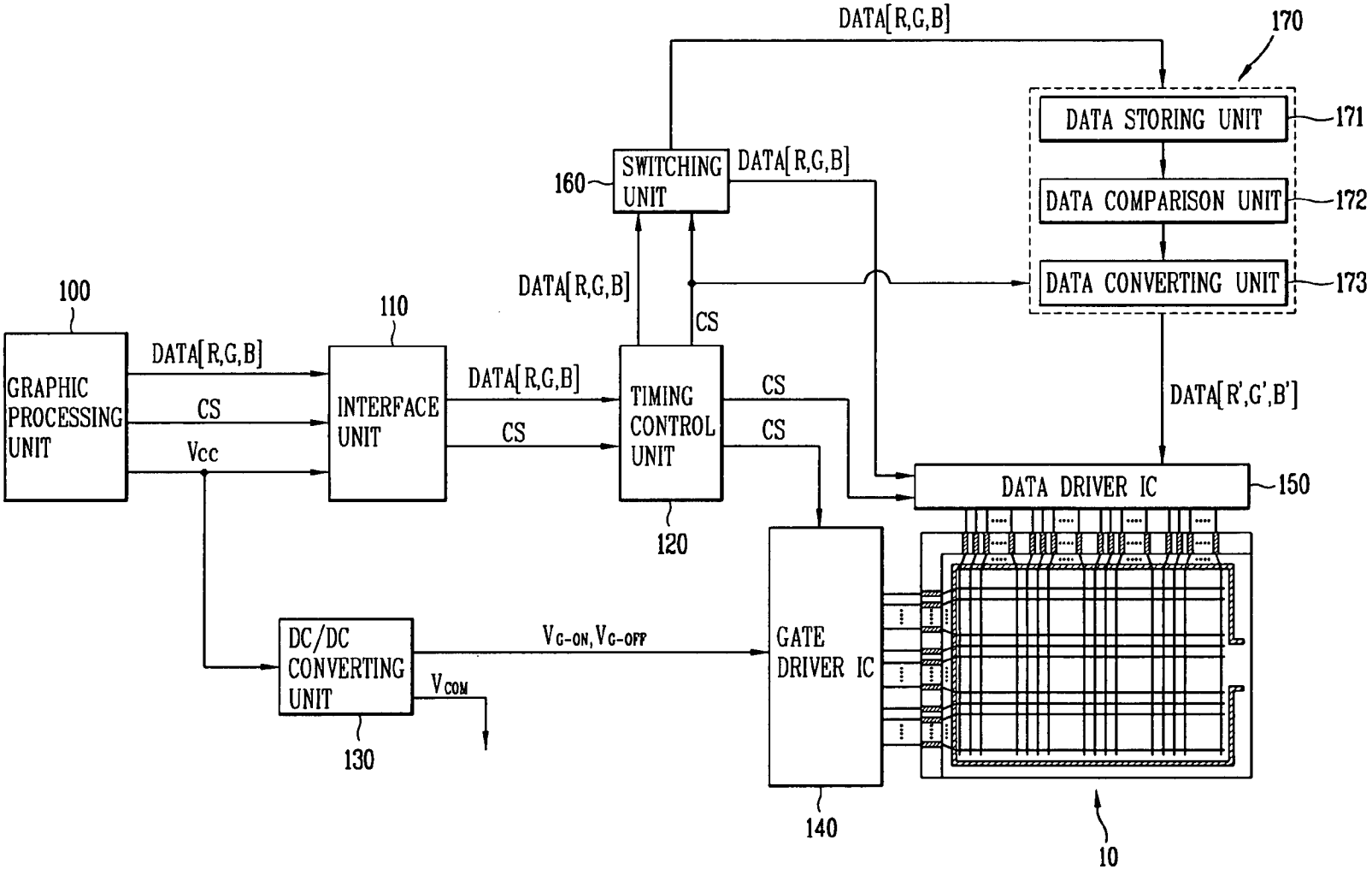
FIG. 7 illustrates a block diagram of a liquid crystal display device according to another embodiment of the present invention.

FIG. 7 illustrates a block diagram of a liquid crystal display device according to another embodiment of the present invention, in which the construction of this embodiment is equivalent to the previous drawing (FIG. 4) and the same elements are represented by the same numerals in the previous drawing (FIG. 4).

Referring to FIG. 7, a liquid crystal display device according to another embodiment of the present invention includes a timing control unit 120 that receives image data R, G, B and a control signal CS from a graphic processing unit 100 through an interface unit 110, a gate driver integrated circuit 140 that supplys a gate pad unit of a liquid crystal display panel 10 with a scan signal by receiving a control signal CS from the timing control unit 120 and by receiving a gate on/off power signal from a DC/DC converter 130, a halftone gray driving mode converting unit 170 that stores data by at least two pixel units by receiving the image data R, G, and B and the control signal CS from the timing control unit 120 and subsequently converting the stored data to new image data R', G', and B' to supply a data driver integrated circuit 150. The data driver integrated circuit 150 supplys a data pad unit of the liquid crystal display panel 10 with the control signal CS supplied from the timing control unit 120 and the new image data R', G', and B' supplied from the halftone gray driving mode converting unit 170.

Moreover, a switching unit 160 is provided between the halftone gray driving mode converting unit 170 and the data driver integrated circuit 150, and determines a halftone gray driving mode or a normal driving mode selectively by receiving control signal CS that enables selection between the normal or halftone gray driving mode from the timing control unit 120.

When the normal driving mode is selected by the switching unit 160, the data driver integrated circuit 150 receives the image data R, G, and B and the control signal CS from the timing control unit 120 to supply the data pad unit of the liquid crystal display panel 10 with the image data R, G, and B and then an image is displayed on the liquid crystal display panel 10.

When the halftone gray driving mode is selected by the switching unit 160, the halftone gray driving mode converting unit 170 receives the image data R, G, and B and the control signal CS from the timing control unit 120 and then supplies the data driver integrated circuit 150 with the new image data R', G', and B' for the halftone gray driving.

The halftone gray driving mode converting unit 170 includes a data storing unit 171 that stores the data applied thereto from the switching unit 160, a data comparison unit 172 that determines a brightness sequence by comparing a brightness of each pixel of the data stored in the data storing unit 171 and then supplies a data converting unit 173 with information for the determined brightness sequence. The data converting unit 173 supplies the data driver integrated circuit 150 with a white level, a black level, and other gray level using the data (gray levels and their brightness information) input from the data comparison unit 172 and a lookup table wherein the data coinciding with a brightness sequence of each pixel of original data is supplied by the data converting unit 173.

Figure 8:
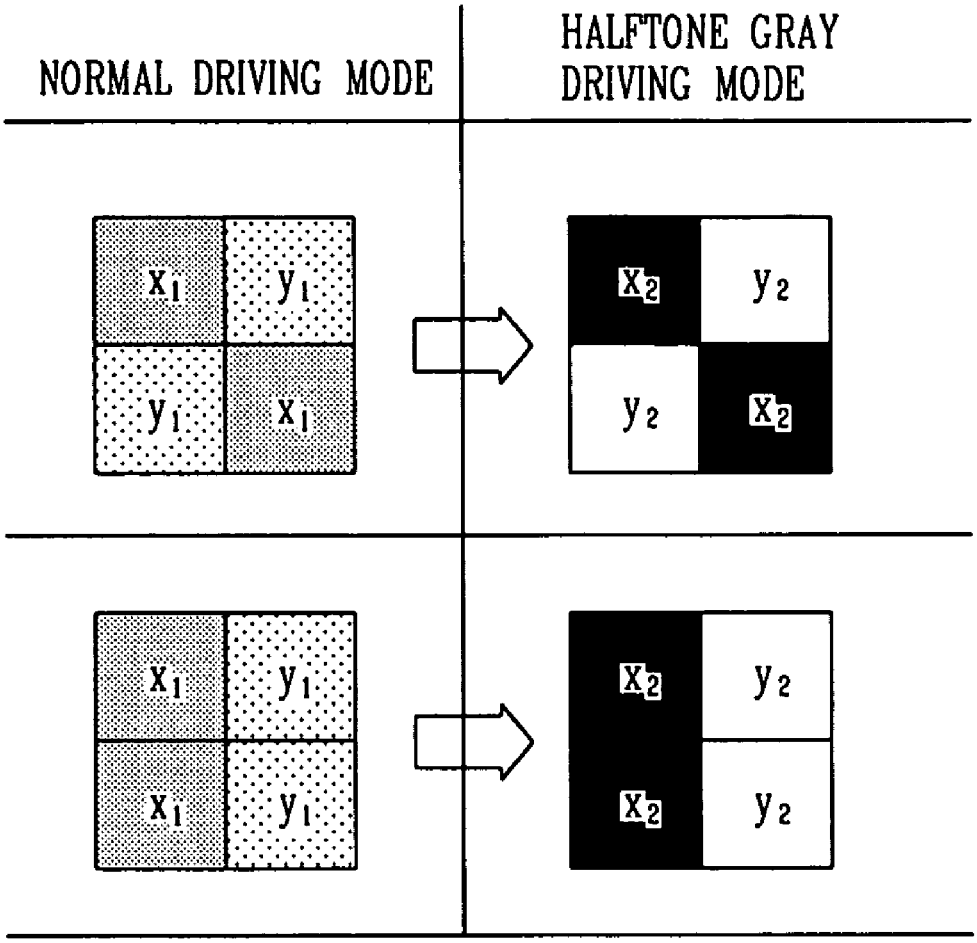
FIG. 8 illustrates a diagram of images displayed on normal and halftone gray driving modes according to the present invention, respectively.

As mentioned in the above description, the data comparison unit 172 is added to the halftone gray driving mode converting unit 170 to display the image having the same brightness sequence per pixel of the original image on halftone gray driving mode. Hence, it is able to maintain the resolution of the image equal to that in normal driving mode as well as improve the viewing angle. Namely, in halftone gray driving mode, as shown in FIG. 8, a dark gray level x1 and a bright gray level y1, which are arranged to form upper and lower straight lines, respectively in normal driving mode, represent a black level x2 and a white level y2 which are arranged as upper and lower straight lines, respectively to have the same brightness sequence per pixel of the normal driving mode. Thus, the image brightness in normal driving mode is equal to that in halftone gray driving mode.

The present invention provides a liquid crystal display device and driving method thereof to improve the viewing angle. Specifically, the halftone gray driving mode converting unit is provided between the timing control unit and the data driver integrated circuit to improve the viewing angle. And, the brightness sequence per pixel on halftone gray mode is made to coincide with that in normal mode. Hence, the viewing angle is improved as well as the resolution of the halftone gray driving mode is maintained equal to that of the normal mode.

Accordingly, the present invention provides the halftone gray driving mode converting unit between the timing control unit and the data driver integrated circuit to implement halftone gray. The brightness sequence per pixel in halftone gray mode is made to coincide with that in normal mode, whereby the resolution of halftone mode is maintained equal to that of normal mode as well as the viewing angle characteristic is improved.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A liquid crystal display device, comprising:

a timing control unit arranged to receive image data and a control signal from a graphic processing unit through an interface unit;

a gate driver integrated circuit for receiving a control signal from the timing control unit and a gate on/off power signal from a DC/DC converter, wherein the gate driver integrated circuit supplies a gate pad unit of a liquid crystal display panel with a scan signal;

a halftone gray driving mode converting unit for implementing halftone gray by receiving the image data and the control signal from the timing control unit;

a data driver integrated circuit for receiving new image data from the halftone gray driving mode converting unit and supplying a data pad unit of the liquid crystal display panel with the new image data; a switching unit between the halftone gray driving mode converting unit and the data driver integrated circuit to switch between a halftone gray driving mode and a normal driving mode based upon a control signal from the timing control unit;

wherein the halftone gray driving mode converting unit includes a data converting unit for converting gray levels of image data to a white level, a black level, and another gray level.

2. The liquid crystal display of claim 1, wherein the halftone gray driving mode converting unit further comprises:

a data storing unit arranged to group and store the data supplied from the timing control unit into a plurality of pixel units.

3. The liquid crystal display device of claim 2, further comprising a data comparison unit between the data storing unit and the data converting unit to compare a brightness sequence per pixel of the data.

4. The liquid crystal display device of claim 3, wherein an average brightness of black and white levels converted by the data converting unit is equal to an average brightness represented by a combination of dark and bright gray levels.

5. A liquid crystal display device, comprising:

a timing control unit arranged to receive image data and a control signal from a graphic processing unit through an interface unit;

a switching unit for receiving the control signal from the timing control unit to selectively switch between a halftone gray mode and a normal mode;

a data storing unit arranged to group and store image data supplied from the timing control unit into a plurality of pixel units;

a data comparison unit to determine a brightness sequence by comparing a brightness sequence for each pixel of the image data stored in the data storing unit;

a data converting unit for receiving information and image data for the brightness sequence for each pixel from the data comparison unit to convert gray levels of the information and image data to a white level, a black level, and another gray level using a lookup table; and a data driver integrated circuit for receiving new image data from the data converting unit and supplying a data pad unit of a liquid crystal display panel with the image data.

6. A method of driving a liquid crystal display device, comprising:

supplying image data and a control signal to a timing control unit;

switching between a halftone gray mode and a normal mode based upon receipt of a control signal from the timing control unit;

storing the image data supplied from the timing control unit as a plurality of pixel units in a data storing unit;

determining a brightness sequence by having a data comparison unit compare a brightness sequence of each pixel of the image data stored in the data storing unit;

receiving information and data for the brightness sequence for each pixel from the data comparison unit and converting the information and data to a white level, a black level, and another level based upon a lookup table value; and supplying a data pad unit of a liquid crystal display panel with image data by receiving new data from a data converting unit.

7. A method of driving a liquid crystal display device, comprising:

supplying image data and a control signal to a timing control unit;

switching between a halftone gray mode and a normal mode based upon receipt of a control signal from the timing control unit;

storing the image data supplied from the timing control unit as a plurality of pixel units in a data storing unit;

converting gray levels of the data stored in the data storing unit to a white level, a black level and other gray levels based upon a lookup table value;

receiving new image data from a data converting unit; and supplying a data pad unit of a liquid crystal display panel with image data.

8. The method of claim 7, further comprising:

comparing a brightness sequence of each pixel of the image data stored in the data storing unit; and supplying the compared brightness sequence information to a data converting unit.

9. A liquid crystal display device, comprising:

a timing control unit arranged to receive image data and a control signal from a graphic processing unit through an interface unit;

a gate driver integrated circuit for receiving a control signal from the timing control unit and a gate on/off power signal from a DC/DC converter, wherein the gate driver integrated circuit supplies a gate pad unit of a liquid crystal display panel with a scan signal;

a halftone gray driving mode converting unit for implementing halftone gray by receiving the image data and the control signal from the timing control unit;

a data driver integrated circuit for receiving new image data from the halftone gray driving mode converting unit and supplying a data pad unit of the liquid crystal display panel with the new image data; and a switching unit between the halftone gray driving mode converting unit and the data driver integrated circuit to switch between a halftone gray driving mode and a normal driving mode based upon a control signal from the timing control unit.

* * * * *